US005514008A

United States Patent [19]

Kocher et al.

[11] Patent Number: 5,514,008

[45] Date of Patent: May 7, 1996

[54] CONNECTOR FOR INTERCONNECTING A FLEXIBLE CIRCUIT TO A CIRCUIT BOARD

[75] Inventors: Timothy L. Kocher, Camp Hill; Randolph L. Buchter, Harrisburg, both of Pa.

[73] Assignee: The Whitaker Corporation, Wilmington, Del.

[21] Appl. No.: 420,894

[22] Filed: Apr. 11, 1995

Related U.S. Application Data

[63] Continuation of Ser. No. 177,825, Jan. 5, 1994, abandoned.

[51] Int. Cl.[6] ..... H01R 9/07

[52] U.S. Cl. ..... 439/495; 439/67

[58] Field of Search ..... 439/495, 496, 439/499, 260, 67, 603

[56] References Cited

U.S. PATENT DOCUMENTS

| | | | |
|---|---|---|---|
| 3,989,336 | 11/1976 | Rizzio, Jr. et al. | 439/260 |
| 4,181,386 | 1/1980 | Olsson | 439/65 |
| 4,252,389 | 2/1981 | Olsson | 439/65 |
| 4,480,886 | 11/1984 | Bergamin | 439/325 |
| 4,519,133 | 5/1985 | Pansanel | 29/863 |
| 4,526,436 | 7/1985 | Aso | 439/499 |
| 4,630,874 | 12/1986 | Renn et al. | 439/263 |
| 4,640,562 | 2/1987 | Shoemaker | 339/17 F |
| 4,718,859 | 1/1988 | Gardner | 439/329 |
| 4,808,113 | 2/1989 | Kanesige et al. | 439/67 |
| 4,936,792 | 6/1990 | Onoue et al. | 439/329 |
| 4,978,315 | 12/1990 | Edgley et al. | 439/441 |
| 4,981,432 | 1/1991 | Kikuchi | 439/417 |
| 5,061,205 | 10/1991 | Toramoto | 439/493 |
| 5,064,383 | 11/1991 | Locati et al. | 439/405 |
| 5,173,058 | 12/1992 | Broeksteeg et al. | 439/267 |
| 5,181,854 | 1/1993 | Masuda | 439/67 |
| 5,194,017 | 3/1993 | Consoli | 439/492 |
| 5,211,577 | 5/1993 | Daugherty | 439/493 |
| 5,213,534 | 5/1993 | Gardner et al. | 439/495 |
| 5,240,430 | 8/1993 | Soes | 439/260 |
| 5,273,450 | 12/1993 | Renn et al. | 439/260 |
| 5,308,262 | 5/1994 | Chishima | 439/495 |
| 5,370,552 | 12/1994 | Chishima et al. | 439/495 |

FOREIGN PATENT DOCUMENTS

| | | | |
|---|---|---|---|
| 2272117 | 5/1994 | United Kingdom | 439/493 |
| 2272583 | 5/1994 | United Kingdom | 439/499 |

*Primary Examiner*—Richard K. Seidel
*Assistant Examiner*—Jeanne M. Elpel

[57] ABSTRACT

A board mounted connector for interconnecting the conductors of the non-terminated end of a flexible circuit or flexible cable to conductive traces on a printed circuit board. The connector includes a two part intermatable housing. The first part of the housing is attached to the circuit board while the second part, having end flanges that slidingly engage the ends of the first part, is movable with respect to the first part between a closed position where the conductors of the flexible circuit are held in contacting engagement with the contacts of the connector and an open position where the flexible circuit is free to be inserted into or removed from the connector. A positive stop is associated with each end of the connector, adjacent diagonally opposite corners, to render the second parts captive to the first part. A detent mechanism is associated with each end of the connector to bias the second part in both its open and closed positions.

12 Claims, 10 Drawing Sheets

CONNECTOR FOR INTERCONNECTING A FLEXIBLE CIRCUIT TO A CIRCUIT BOARD

This application is a Continuation of application Ser. No. 08/177,825 filed Jan. 5, 1994, now abandoned.

The present invention relates to circuit board mounted connectors for interconnecting the conductors of a flexible circuit to conductive traces on a printed circuit board and more particularly to such connectors having a two part matable housing.

BACKGROUND OF THE INVENTION

Board mounted connectors for interconnecting the conductors of the non-terminated end of a flexible circuit or flexible cable to conductive traces on a printed circuit board typically include a two part intermatable housing. The first part of the housing is attached to the circuit board while the second part is movable with respect to the first part between a closed position where the conductors of the flexible circuit are held in contacting engagement with the contacts of the connector and an open position where the flexible circuit is free to be inserted into or removed from the connector. The contacts of the connector have tails that are usually soldered to the conductive traces on the printed circuit board. It is desirable that the second part of the housing be captive to the first part and that detentes be provided that tend to hold the second part in both the open and closed positions until deliberately moved into the other position. Such requirements are usually met by bayonet type projections extending from one of the parts that mate with corresponding cavities in the other part. The projections and cavities are arranged near opposite ends of the connector, for example, as shown in U.S. Pat. No. 5,194,017 which issued Mar. 16, 1993 to Consoli. The '017 patent discloses a two part connector for interconnecting a flexible circuit to a circuit board. The board mounted portion of the connector housing includes a pair of cavities, one at each end while the movable portion has projections extending from each end that mate with the cavities. Each of the projections includes two spaced detentes that cooperate with their respective cavities to define the open and closed positions of the connector parts. Such bayonet and mating cavity structures are rather substantial in size and, therefore, require considerable space. In very high density applications, space is at a premium so such structures are unsuitable.

What is needed is an economical two part flexible circuit connector that includes a structure for holding the two parts captive including a two position detent that does not appreciably increase the overall size of the connector, yet is effective and simple to operate.

SUMMARY OF THE INVENTION

An electrical connector is disclosed for interconnecting conductors of a flexible circuit to conductive traces on a printed circuit board. The connector includes a first housing having an opening for receiving an end of the flexible circuit and means for attaching the first housing to the printed circuit board A plurality of contacts are arranged in the first housing to contact the conductors of the flexible circuit. Each contact has a tail for contact with a respective trace on the printed circuit board. A second housing is in intermating engagement with the first housing and arranged to move with respect thereto between a first position wherein each of the conductors of the flexible circuit within the opening is urged against a respective one of the plurality of contacts and a second position wherein the flexible circuit is free to be inserted into or removed from the opening. Means is included for holding the second housing captive to the first housing comprising a positive stop associated with corresponding adjacent corners of the first and second housings.

DESCRIPTION OF THE PREFERRED EMBODIMENT

Figure 1:
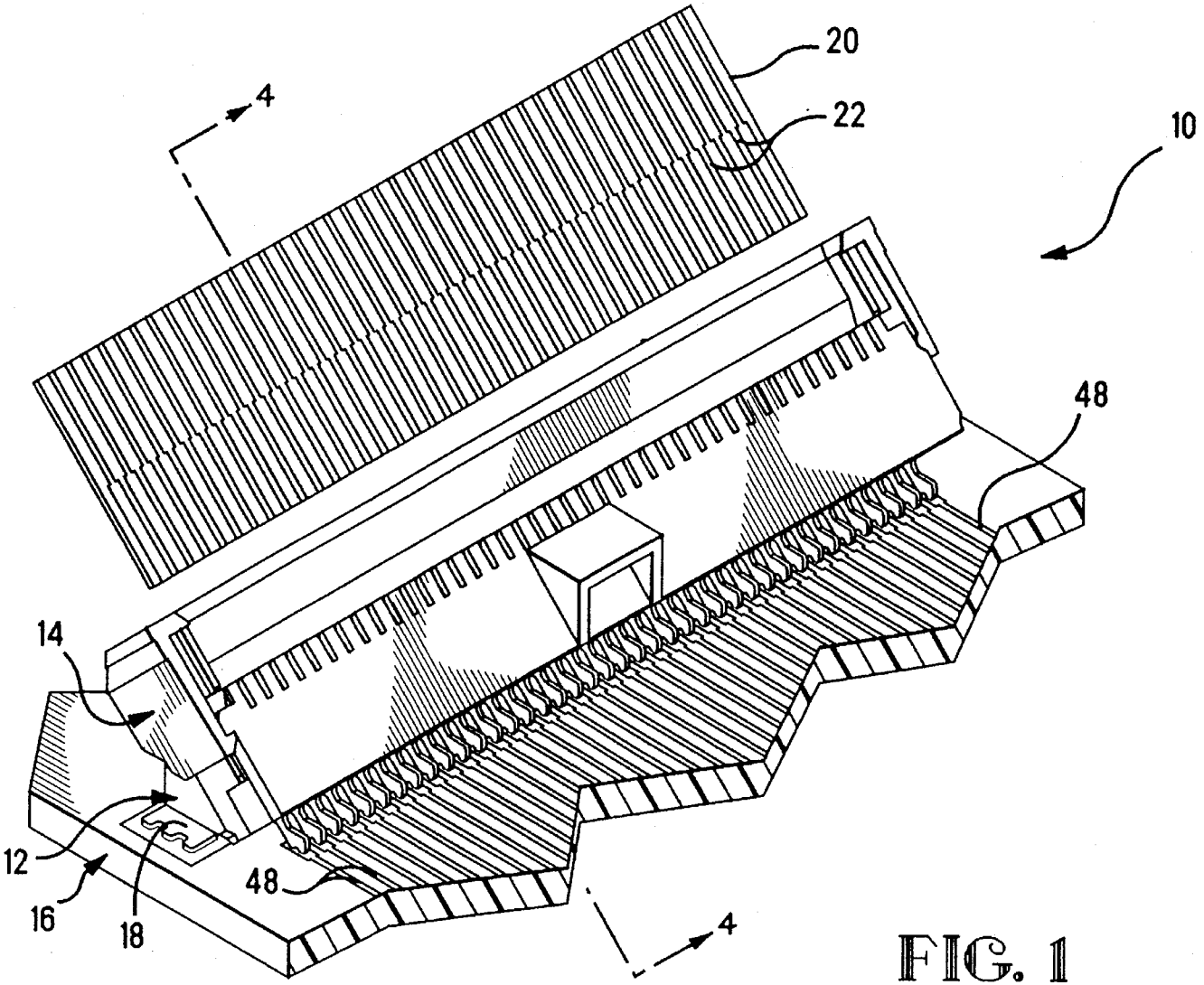
FIG. 1 is an isometric view of a connector incorporating the teachings of the present invention.
Figure 2:
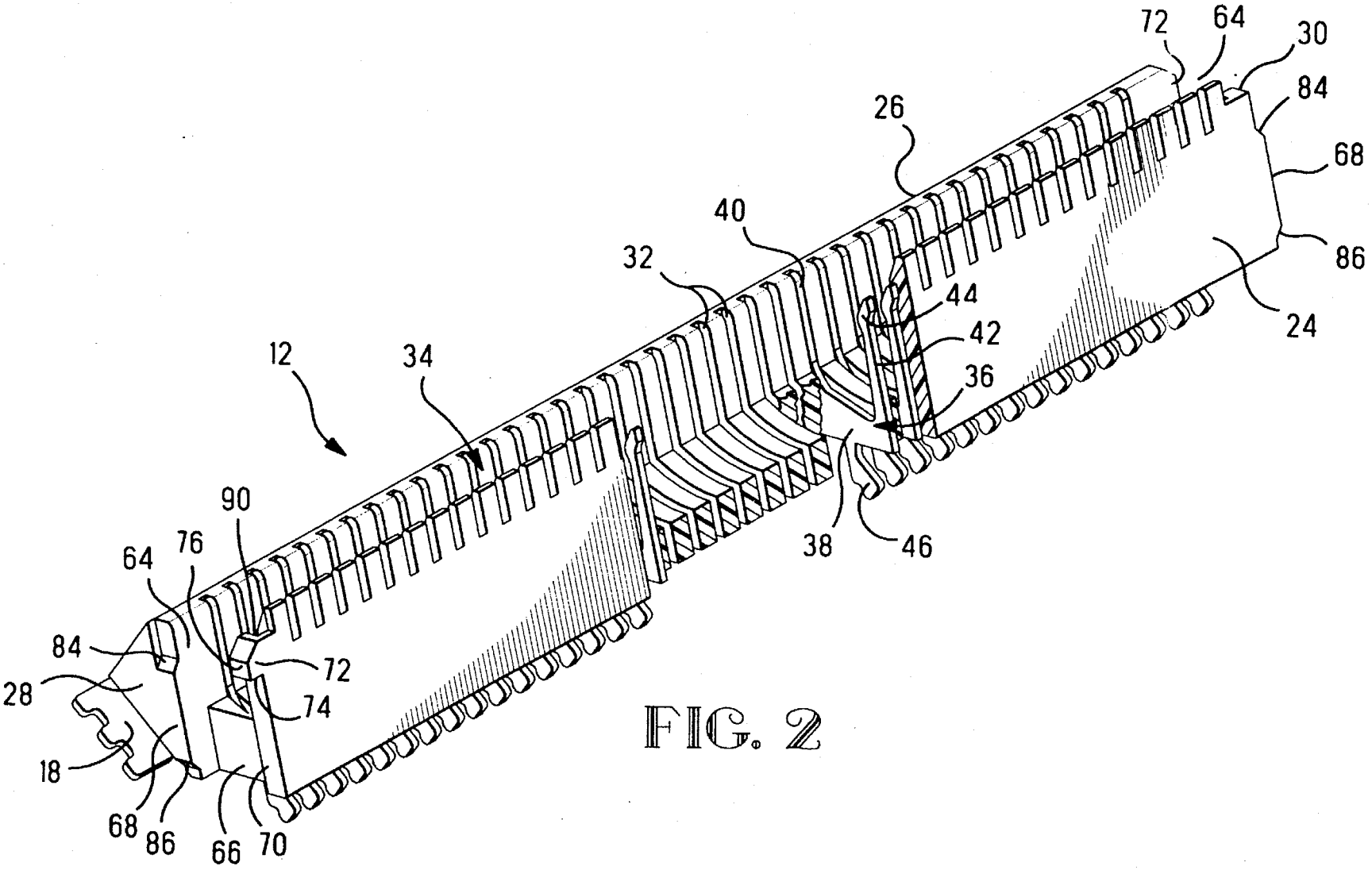
FIG. 2 is an isometric view of the stationary part of the connector shown in FIG. 1 that attaches to the circuit board.
Figure 4:
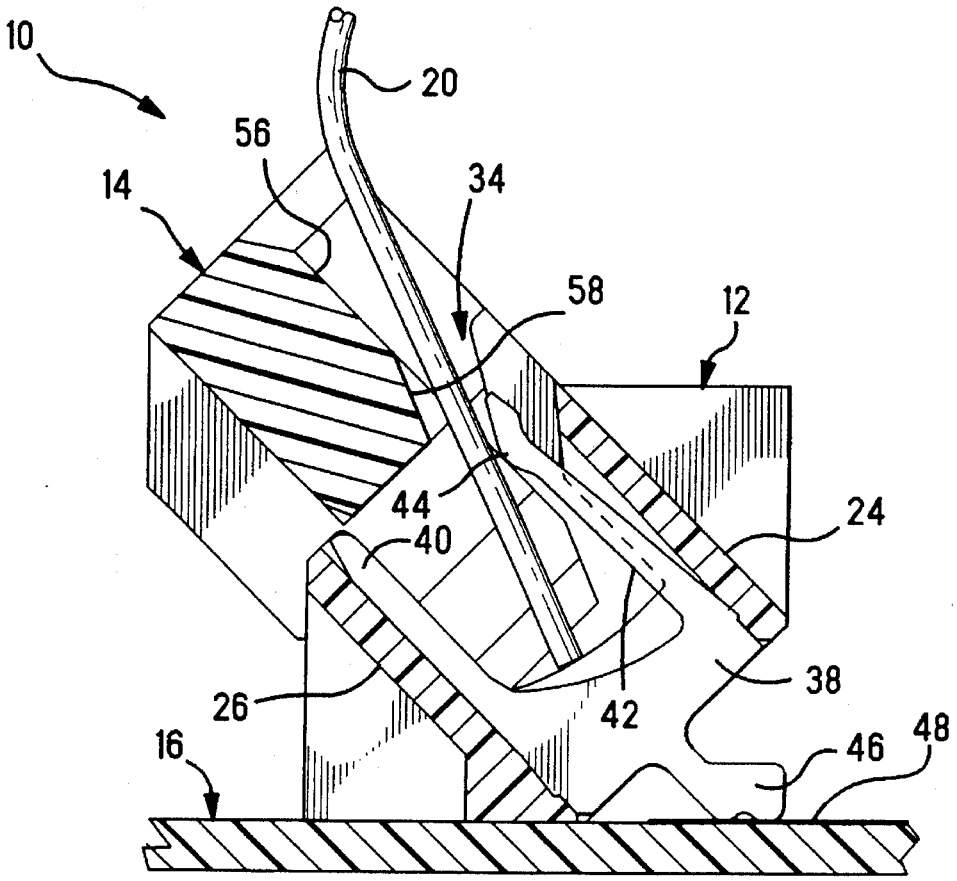
FIG. 4 is a cross-sectional view taken along the lines 4—4 of FIG. 1 showing the connector in its open position.

There is shown in FIG. 1 a connector 10 having a stationary housing part 12 and a movable housing part 14 intermatable with the housing part 12, shown in its open position. The stationary part 12 is adapted to be attached to a circuit board 16 by means of a pair of conductive brackets 18 that are soldered to metalization on the circuit board. Each of the brackets 18 is secured along an edge of the housing part 12 that is inclined, for example, 45 degrees with respect to a front wall 24 and a back wall 26. The stationary connector part 12, as best seen in FIG. 2, is an elongated box-like structure having a front wall 24, a back wall 26, and first and second ends 28 and 30, respectively. A flexible circuit 20 having conductors 22 thereon is shown in FIG. 1, in position ready to be inserted into the open connector 10 between the walls 24 and 26. A plurality of cavities 32 are formed within the interior of the connector housing part 12 arranged side by side, each of the cavities containing an electrical contact 36 which are accessible through an opening 34 formed in the housing part 12. The cavities 32 and contacts 36 are spaced on center to center distances identical to the spacing of the conductors 22 of the flexible circuit 20. As best seen in FIGS. 2 and 4 each of the contacts 36 includes a base 38, a support member 40 extending from the base upwardly within the cavity 32 along the back wall 26, and a beam 42 extending from the base upwardly within the cavity adjacent the front wall 24. The beam 42 has a contact 44 near its free end in opposed relation to the member 40. The free end of the beam 42 diverges from the front wall 24 to permit deflection of the contact and beam when the flexible circuit is to be inserted into place and the connector closed, as will be described below. A solder tail 46 extends downwardly from the base 38 and engages a respective conductive trace 48 on the circuit board 16.

Figure 3:
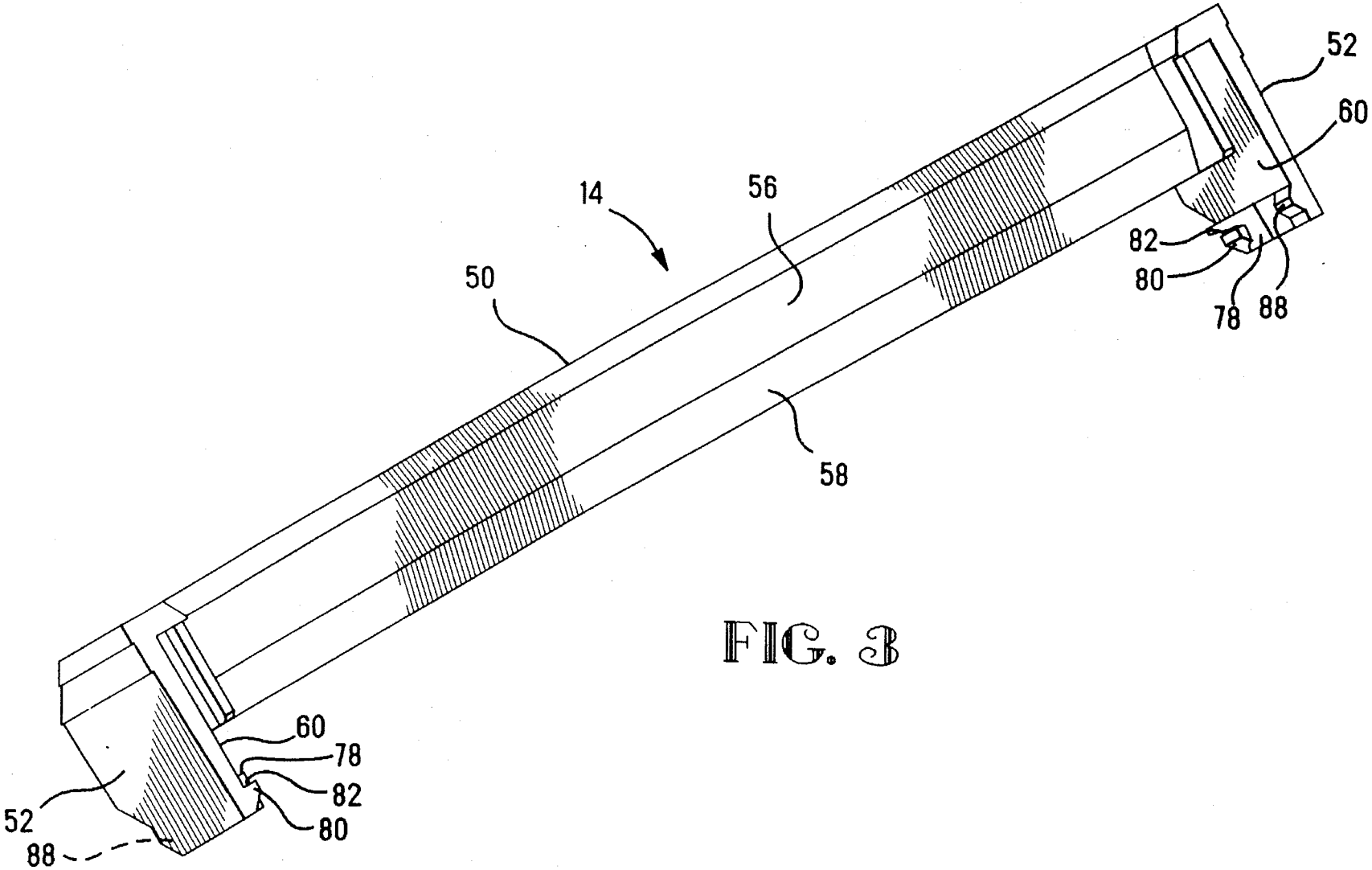
FIG. 3 is an isometric view of the movable part of the connector shown in FIG. 1 that slidingly mates with the connector part shown in FIG. 2.
Figure 5:
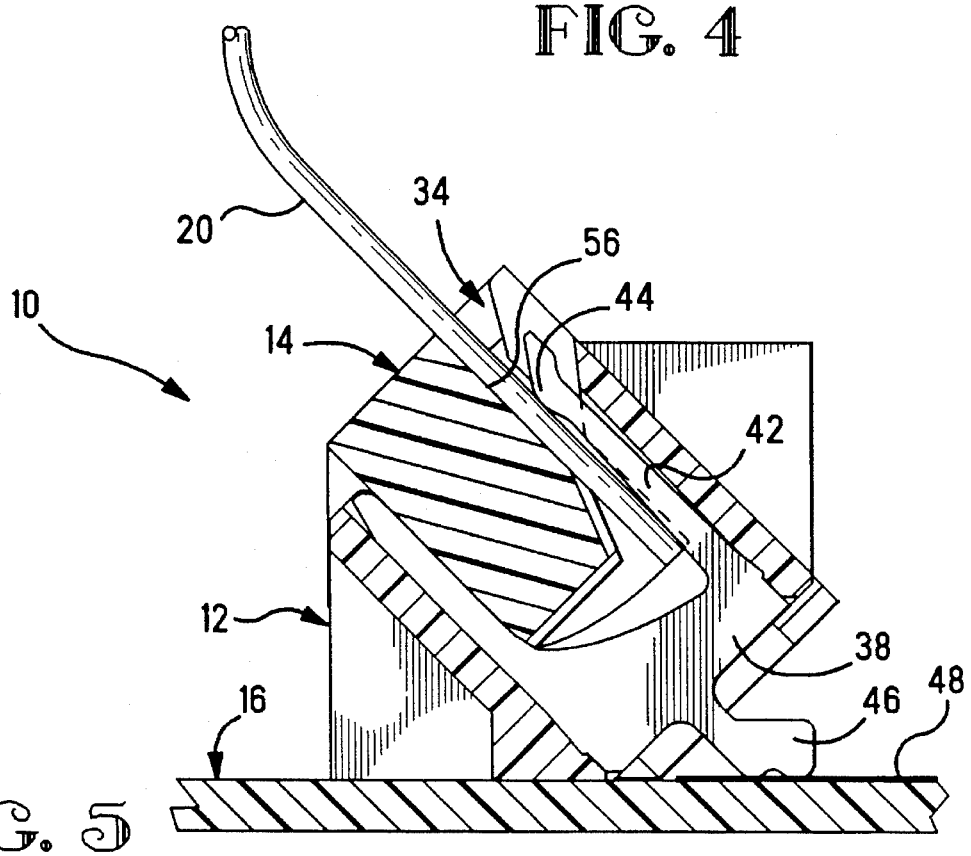
FIG. 5 is a cross-sectional view similar to that of FIG. 4 showing the connector in its closed position.

The movable housing part 14, as best seen in FIG. 3, includes an elongated stuffer bar 50 having a first flange 52 at one end thereof and a second identical flange 52 at the other end. The bar 50 has a flexible circuit engaging surface 56 for pressing the flexible circuit against the contacts 44 when the connector 10 is in its closed position. A bevel 58 extends the length of the bar 50 and serves as a lead-in when inserting the flexible circuit into the opening 34 and moving the housing part 14 to its closed position, as will be explained below. The first and second flanges 52 each have inwardly directed faces 60 that are spaced apart to form a sliding fit with the first and second ends 28 and 30 when the movable housing part 14 is assembled to the stationary housing part 12 as shown in FIGS. 1 and 9–11. The movable part 14 is movable from the connector's open position shown in FIGS. 1, 4 and 10 to its closed position shown in FIGS. 5 and 11. A clearance opening 64 is formed in each of the ends 28 and 30 to receive the stuffer bar 50. To interconnect the conductors 22 of the flexible circuit 20 to the conductive traces 48 of the circuit board 16, the movable housing part 14 is moved to its open position as shown in FIGS. 4 and 10, and the flexible circuit inserted into the opening 34. The movable housing part 14 is then moved in a direction toward the contact base 38 causing the lead-in bevel 58 to engage the flexible circuit 20 and to urge it against each contact 44, thereby deflecting the beam 42 and moving the contact 44 a small amount toward the front wall 24. Movement of the housing part 14 continues until it is in its fully closed position as shown in FIGS. 5 and 11.

Figure 6:
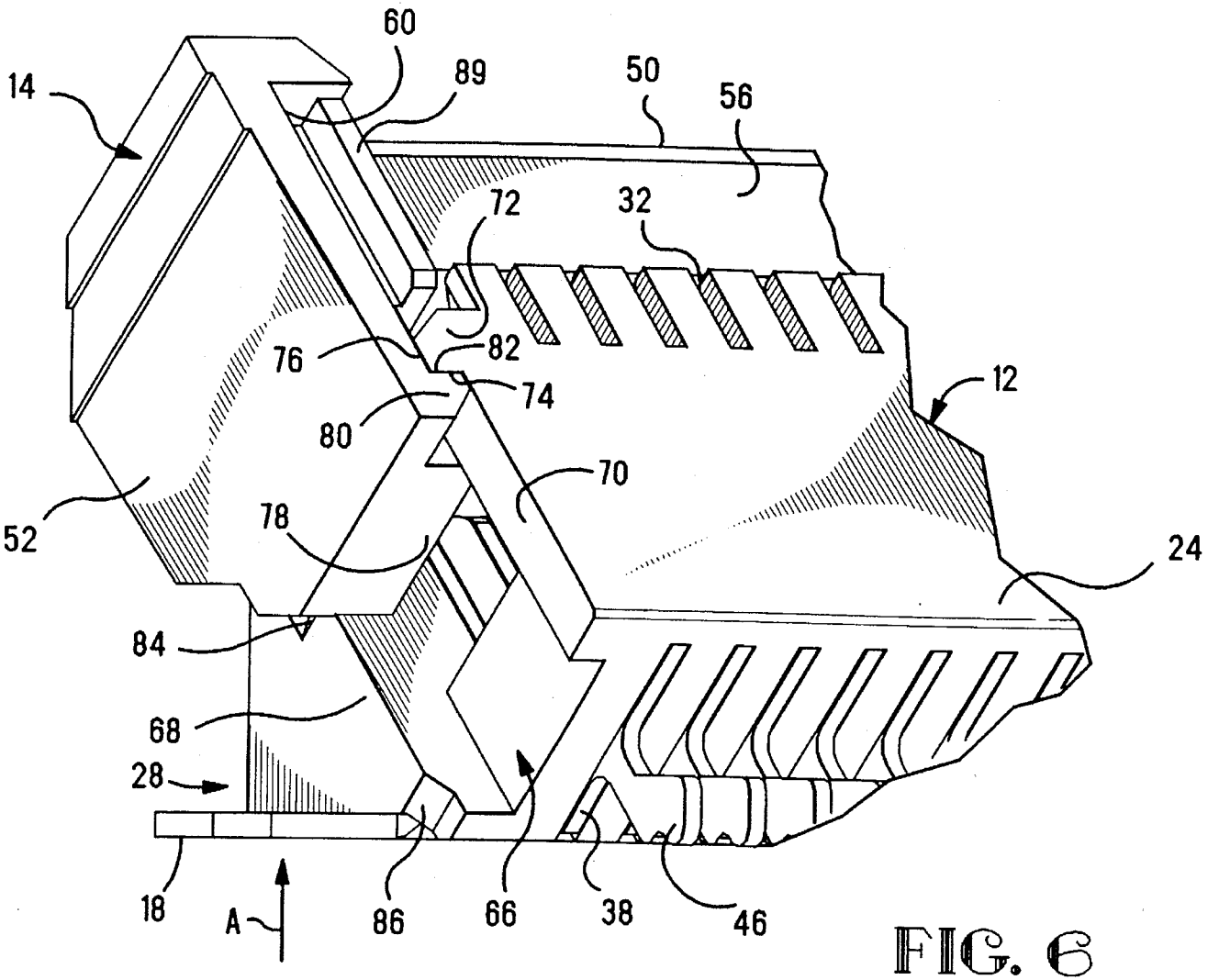
FIG. 6 is an isometric view of a portion of the connector of FIG. 1 showing the connector in its open position.
Figure 7:
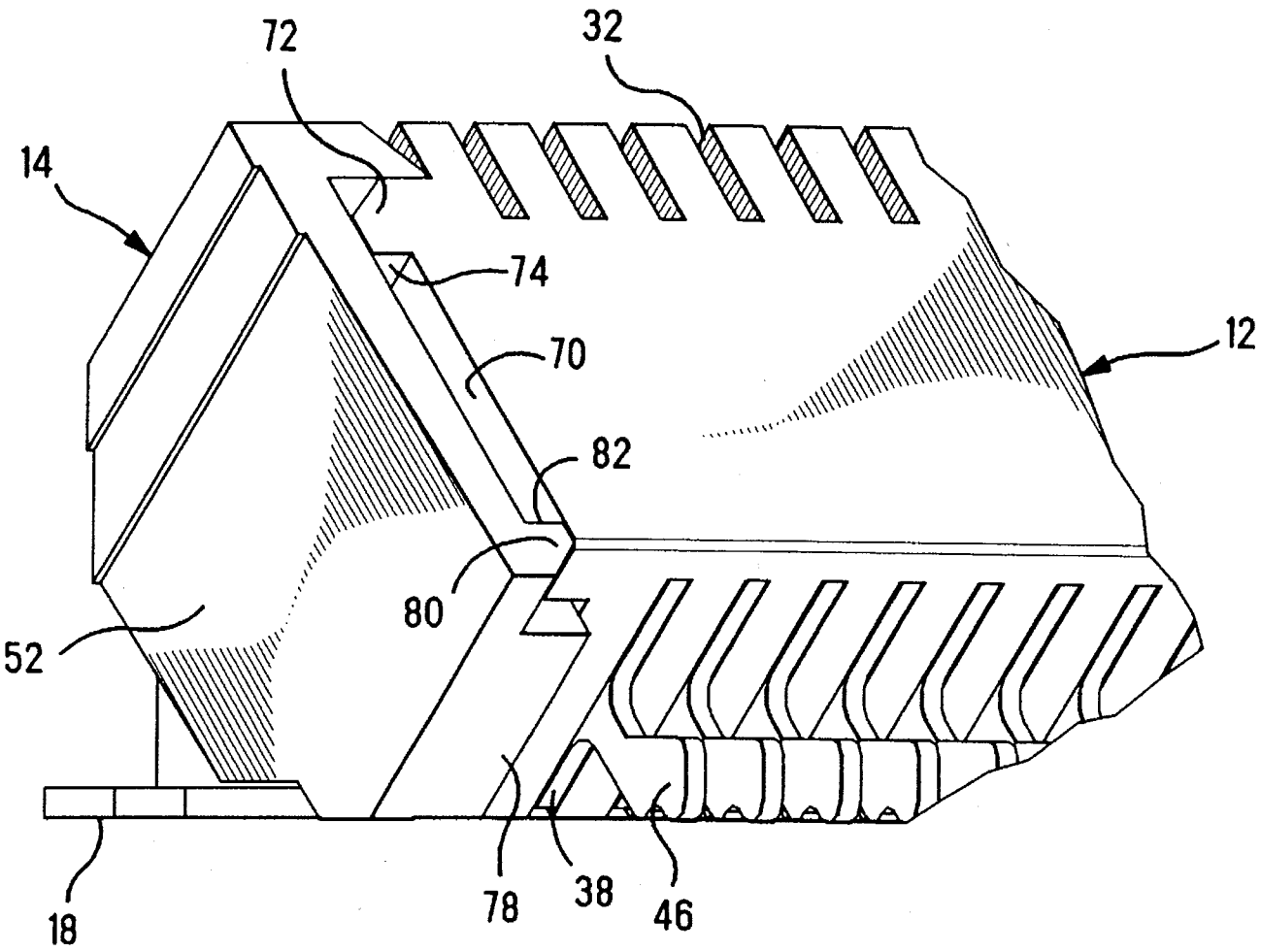
FIG. 7 is a view similar to that of FIG. 6 showing the connector in its closed position.
Figure 8:
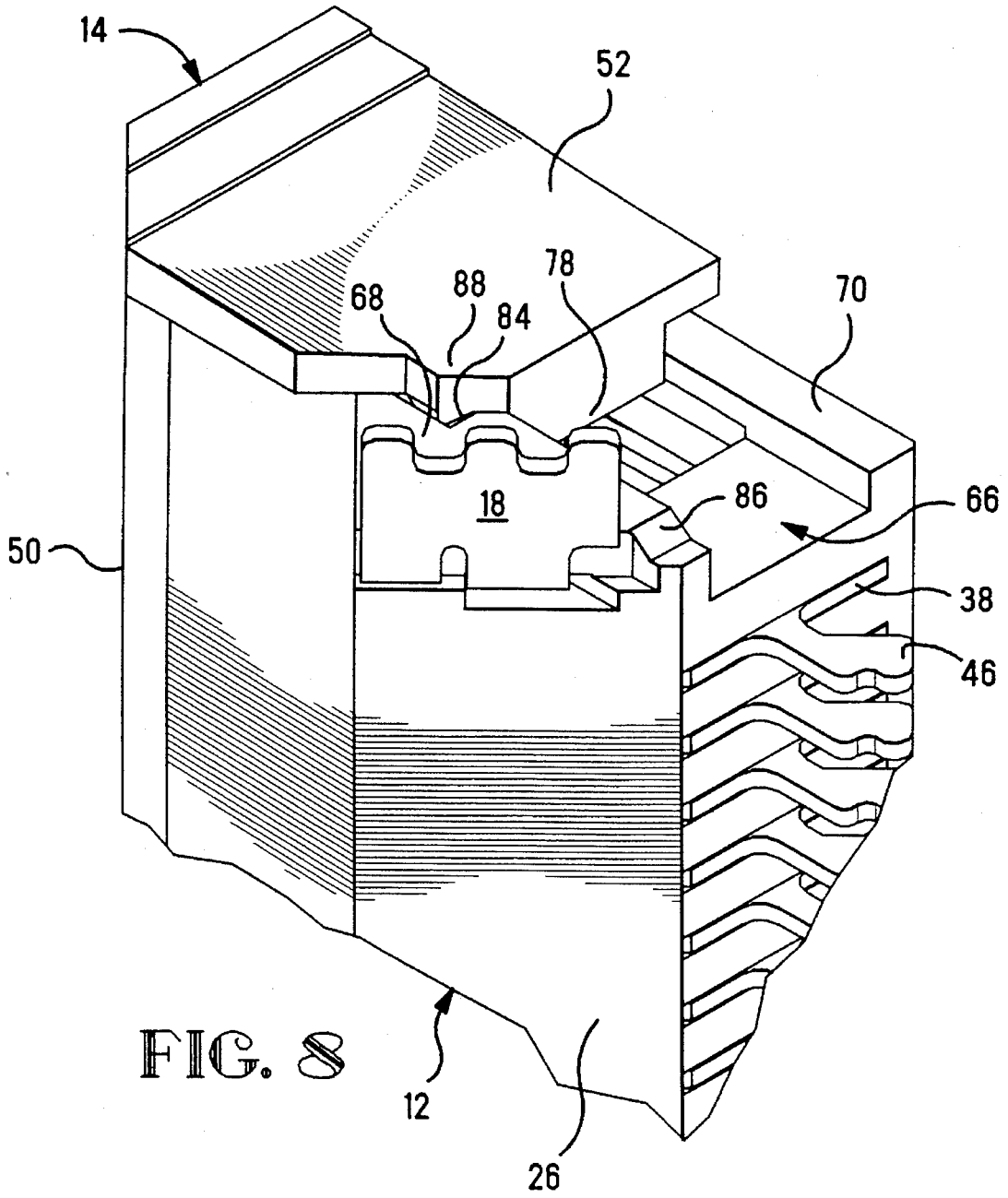
FIG. 8 is a view similar to that of FIG. 6 taken from the direction of the arrow A in FIG. 6.
Figure 9:
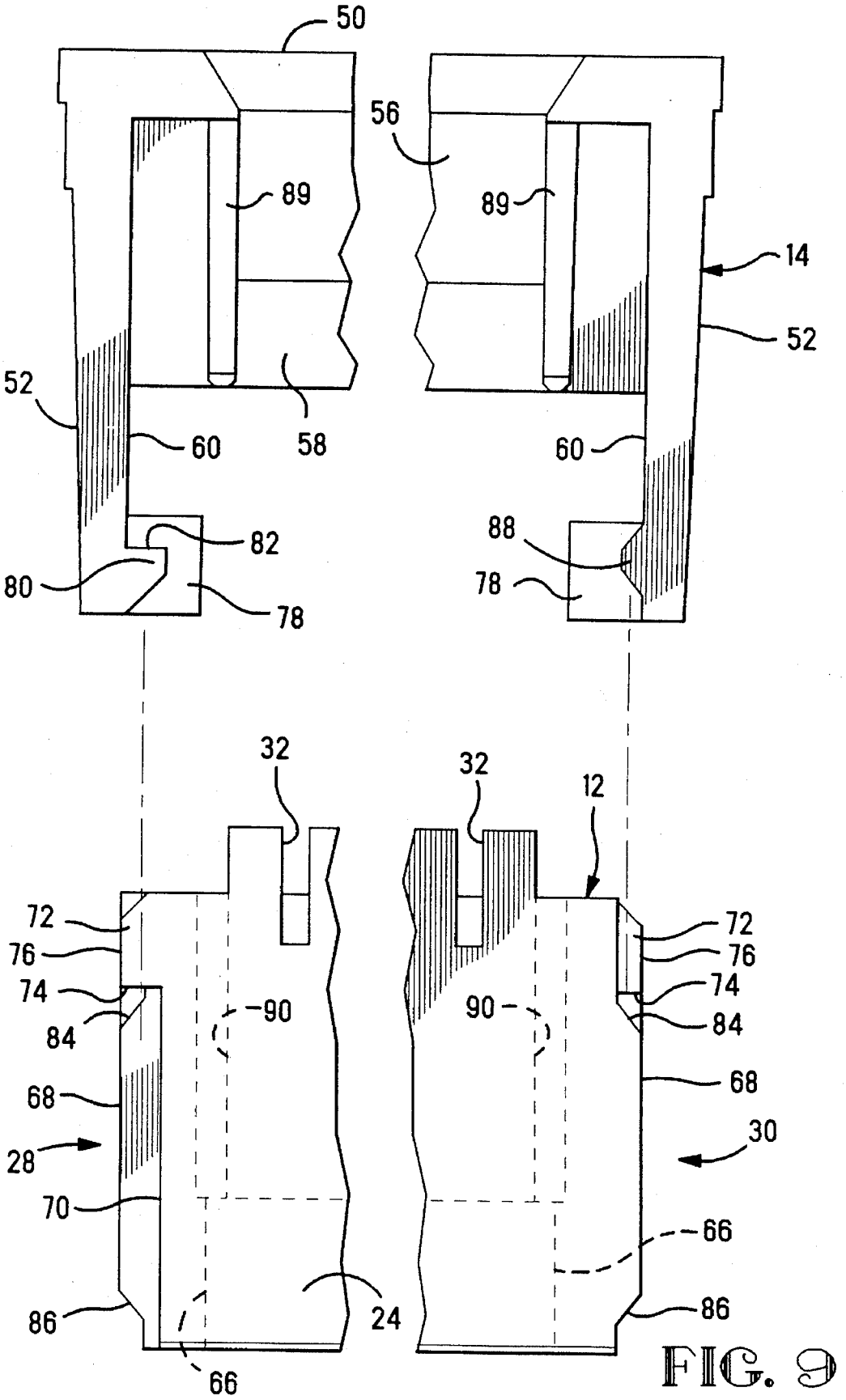
FIG. 9 is a fragmentary side view of the stationary and moveable parts of the connector.
Figure 10:
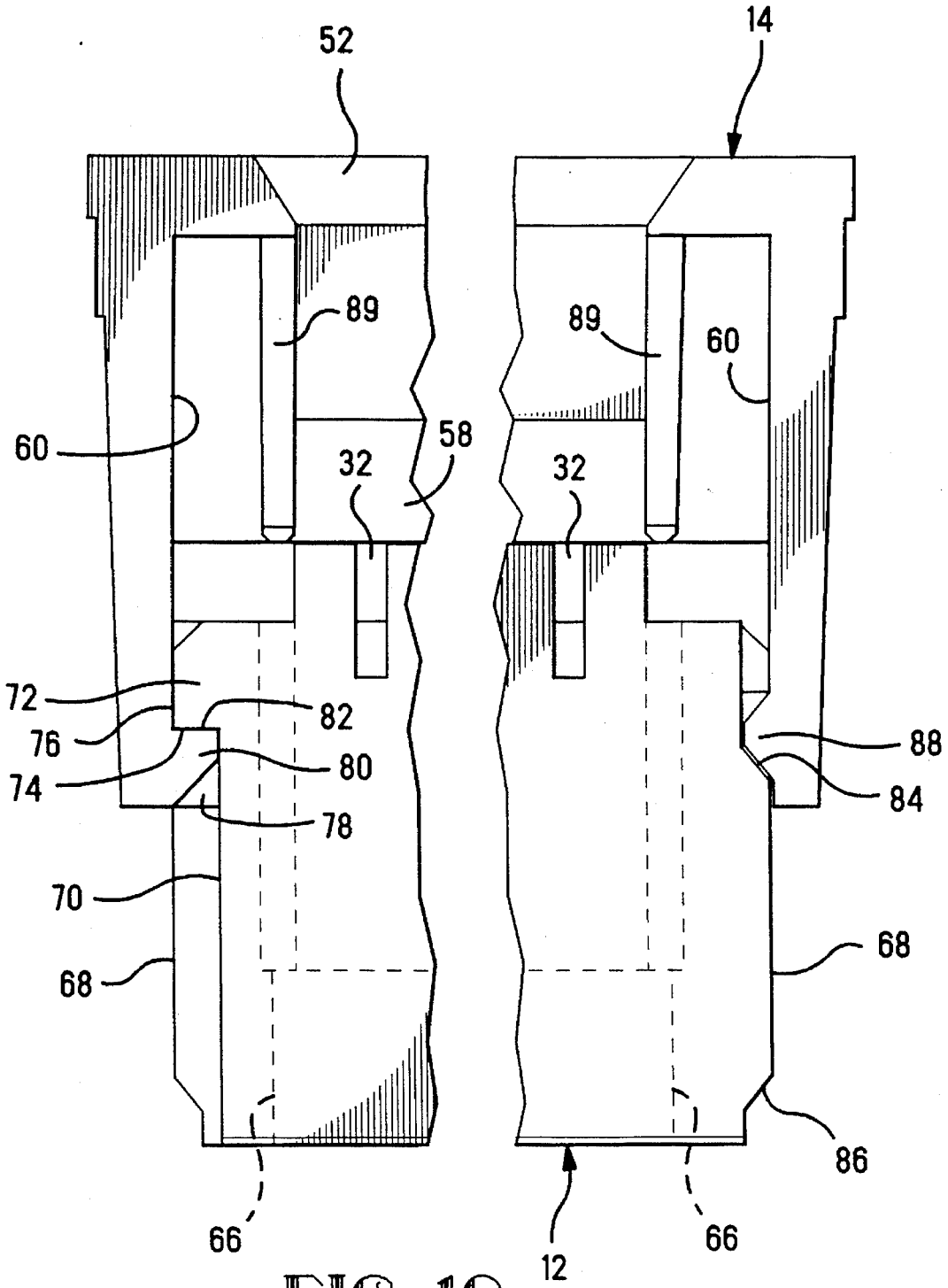
FIG. 10 is a view similar to FIG. 9 illustrating the parts in first assembled positions.
Figure 11:
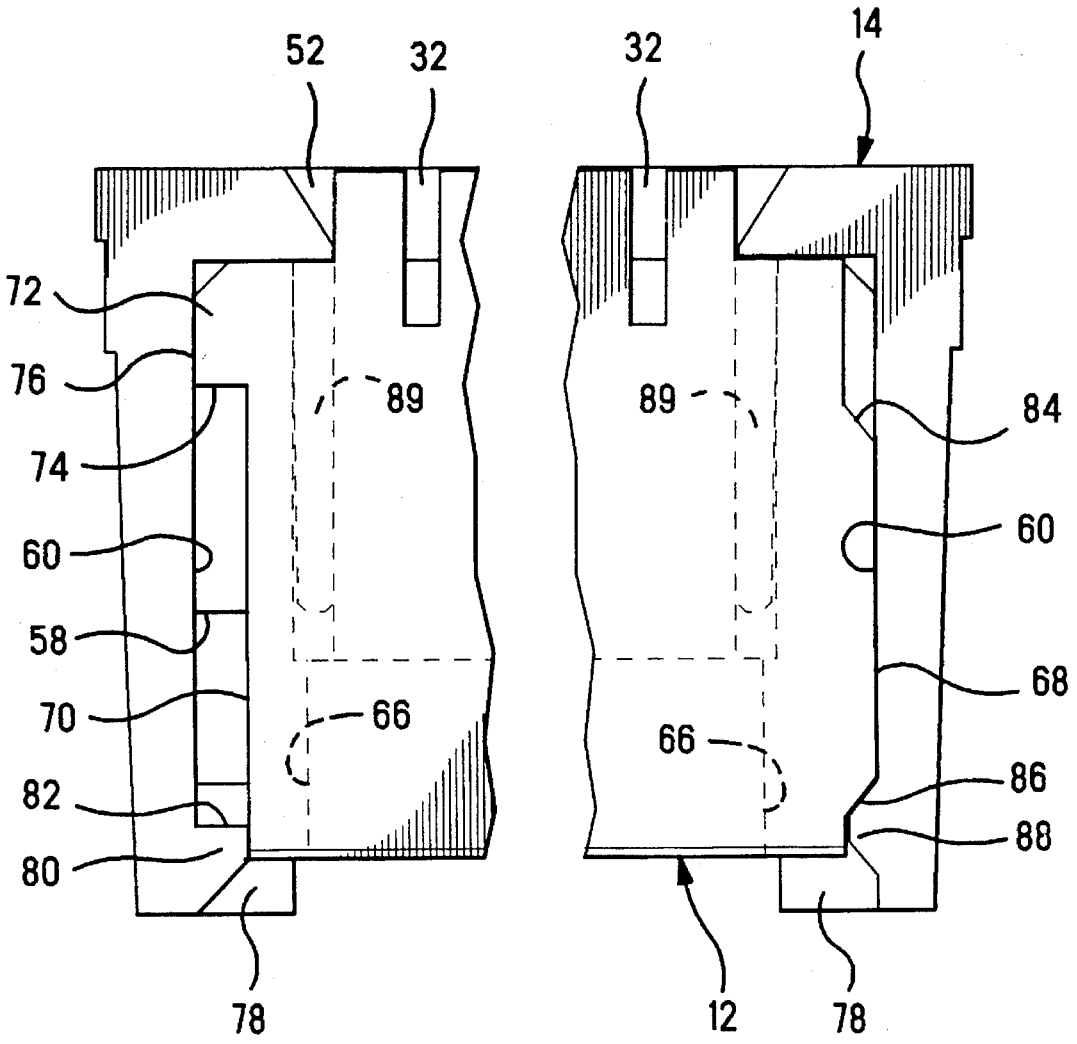
FIG. 11 is a view similar to FIG. 9 illustrating the parts in second assembled positions.

As best seen in FIGS. 6, 9 and 10, the end 28 of the stationary housing part 12 includes a guide channel 66 defined by a pair of rails on each side having outwardly directed mutually parallel surfaces 68 and 70 on each of diagonally opposite corners of the part 12. The surface 70 includes a projection 72 having a downwardly facing stop surface 74. The projection 72 has an end surface 76 that is somewhat coplanar with the surface 68. Each flange 52 has a guide member 78 that extends into the guide channel 66 and is sized to slide freely therewithin with little appreciable end play. The inwardly directed face 60 of the flange 52 is in sliding engagement with the surfaces 68 and 76. The flange 52 includes an ear 80 extending toward the surface 70 that includes an upwardly facing stop surface 82 that is in opposed relationship with the stop surface 74. As the housing part 14 is moved to its open position, as shown in FIGS. 6 and 10, the two stop surfaces 74 and 82 abut thereby holding the housing part 14 captive to the housing part 12. An upper detent ramp 84 is indented into the upper end of the surface 68 and a similar but oppositely oriented detent ramp 86 is indented into the lower end of the surface 68, as shown in FIG. 6. The face 60 includes a detent projection 88, as best seen in FIG. 8, that is in engagement with the detent ramp 84. This holds or biases, the movable housing part 14 in its open position as shown in FIGS. 6, 8 and 10. Each flange 52 has a projecting key 89 that fits slidably along a keyway 90, FIG. 2. When the housing part 14 is forced downwardly toward its closed position, the flange 52 resiliently deflects outwardly a slight amount to permit the detent projection 88 to cam out of the upper detent ramp 84 and ride along the surface 68 until the housing part 14 very nearly reaches its closed position. At this point the detent projection snaps into the lower detent ramp 86 thereby holding, or biasing, the housing part 14 in its closed position, as shown in FIGS. 7 and 11, until forced open again. The other end of the housing part 14 is similarly constructed in that the flange 52 thereon is identically constructed, but is turned with respect to the other flange 52 to face in an opposite direction. Note that the two ears 80 and 80 are adjacent diagonally opposite corners, and the two detent projections 88 and 88 are adjacent two different but diagonally opposite corners. Note that the two projections 72 and 72' are adjacent diagonally opposite corners corresponding with the positions of the ears 80 and 80, and the two pairs of detent ramps 84, 86 and 84, 86 are adjacent two different but diagonally opposite corners. Therefore, the two stop surfaces 74 and 74 will abut the two stop surfaces 82 and 82 on diagonally opposite corners of the connector 10. This is important to prevent inadvertent separation of the two housing parts 12 and 14 by rotating the movable part 14 about its longitudinal axis when it is in its open position.

In operation the movable housing part 14 is moved to its open position as shown in FIGS. 1 and 4 with the detent projections 88 and 88 engaging their respective detent ramps 84 and 84. The flexible circuit 20 is inserted into the opening 34 and the movable housing part 14 is then urged in a direction toward the contact base 38. This causes the lead-in bevel 58 to engage the flexible circuit 20 urging it against the contact 44, thereby deflecting the beam 42 and moving the contact toward the front wall 24. Movement of the housing part 14 continues until it is in its fully closed position, as shown in FIGS. 5 and 8, with the detent projections 88 and 88 in engagement with the lower detent ramps 84 and 84. In this position each of the conductors 22 is firmly held in electrical engagement with a respective contact 44, thereby completing the interconnection between the conductors 22 and the conductive traces 48. If desired, the flexible circuit 20 may be removed from the connector 10 by moving the housing part 14 to its open position, as shown on FIG. 4, and simply pulling the flexible circuit out of the opening 34.

It is important that the two flanges 52 and 54 be sufficiently resilient to deflect and allow the detent projections 88 and 88 to cam out and away from their respective detent ramps 84 and 84 when the housing part 14 is moved between its open and closed positions, yet will allow the projections to resiliently snap back into engagement with the detent ramps when returned to either of these positions. This results in the flanges 52 and 54 being relatively thin so that the detent and positive stop functions add very little to the overall length of the connector 10. It will be understood that, while in the present example, a flexible circuit 20 is shown interconnected to the circuit board 16, a ribbon cable or similar relatively flat structure having conductors disposed in a common plane may also be interconnected to the circuit board by the connector 10. The term "flexible circuit" as used herein is intended to include these other structures. While the connector 10, in the present example, is shown at a 45 degree angle with respect to the mounting surface of the printed circuit board 16, it will be understood that the teachings of the present invention may be advantageously utilized with connectors arranged at angles other than 45 degrees, including angles of zero degrees and 90 degrees with respect to the circuit board. The 45 degree angle version, being the preferred embodiment, has the benefit of being more convenient when inserting or removing the flexible circuit as well as eliminating the need for a sharp angle bend in the flexible circuit where it exits the connector due to proximity of other components or cabinet structure.

An important advantage of the present invention is that a positive stop is provided that adds very little to the overall length of the connector, yet is effective in preventing inadvertent separation of the two housing parts. Additionally, the resilient flange structure permits simplified detentes for holding the housing parts in both their open and closed positions, without increasing the physical size of the connector.

We claim:

1. An electrical connector for interconnecting conductors of a flexible circuit to conductive traces on a circuit board comprising:

(a) a first housing having an opening for receiving said flexible circuit;

(b) at least one bracket on the first housing for attachment to a circuit board, (c) multiple contacts in the first housing to engage conductors on said flexible circuit, the contacts having respective tails to engage respective conductive traces on the circuit board;

(d) a second housing engaged and intermating with the first housing and moveable between a first position whereby the opening receives therein the flexible circuit, and a second position whereby conductors of the flexible circuit are urged against respective contacts to establish electrical connections therewith, and a pair of opposite first ends on said first housing, a pair of opposite second ends on said second housing that closely overlap respective said first ends in sliding engagement therewith, a positive stop including a pair of first abutting surfaces adjacent diagonally opposite corners on said first housing, said first abutting surfaces being associated with respective first ends, a pair of second abutting surfaces associated with respective second ends adjacent diagonally opposite corners on said second housing, and each of said first abutting surfaces being arranged in opposed spaced relationship with a corresponding one of said second abutting surfaces when said housings are in said closed position, and being in opposed adjacent relationship when said housings are in said open position.

2. The connector according to claim 1 wherein said first abutting surfaces are arranged to interferingly abut said second abutting surfaces to prevent separation of said first and second housings.

3. The connector according to claim 2 wherein each of said first abutting surfaces is on a respective first projection extending outwardly from a respective first end and including a clearance recess in each of said second ends for receiving a respective one of said first projections during movement of said first and second housings between said open and closed positions.

4. The connector according to claim 2 wherein each of said second abutting surfaces is on a respective second projection extending outwardly from a respective second end and including a clearance recess in each of said first ends for receiving a respective one of said second projections during movement of said first and second housings between said open and closed positions.

5. An electrical connector for interconnecting conductors of a flexible circuit to conductive traces on a circuit board comprising:

(a) a first housing having an opening for receiving said flexible circuit;

(b) at least one bracket on the first housing for attachment to a circuit board;

(c) multiple contacts in the first housing to engage conductors on said flexible circuit, the contacts having respective tails to engage respective conductive traces on the circuit board;

(d) a second housing engaged and intermating with the first housing and movable between a first position whereby the opening receives therein the flexible circuit, and a second position whereby conductors of the flexible circuit are urged against respective contacts to establish electrical connections therewith, and said first housing includes first and second opposite ends and said second housing includes an elongated member having a first flange attached to one end thereof and a second flange attached to the other end thereof, said first and second flanges having opposing first and second faces in sliding engagement with said first and second opposite ends respectively for guiding said second housing during movement thereof between said first and second positions, said elongated member arranged to be received within said opening to effect said urging of said conductors of said flexible circuit against said contacts when said second housing is moved from said first position to said second position, and including a pair of positive stops associated with diagonally opposite corners of said first and second housings holding said second housing captive to said first housing during said movement of said second housing.

6. The connector according to claim 5 wherein said positive stop includes a first abutting surface extending outwardly from said first end and a second abutting surface extending outwardly from said second end adjacent diagonally opposite corners of said first housing, and said second housing having first and second recesses in said first and second opposing faces within which said first and second abutting surfaces, respectively, extend so that when said second housing is moved from said closed position to said open position said first and second abutting surfaces cooperate with the ends of said recesses to maintain said second housing captive with said first housing.

7. An electrical connector for interconnecting conductors of a flexible circuit to conductive traces on a printed circuit board comprising:

(a) a first housing having first and second opposite ends and an opening for receiving an end of said flexible circuit;

(b) a plurality of contacts arranged in said first housing to contact said conductors of said flexible circuit, each contact having a tail for contact with a respective trace on said printed circuit board;

(c) a second housing associated with said first housing, being movable with respect thereto from a closed position to an open position and from an open position to a closed position, including an elongated member having a first flange attached to one end thereof and a second flange attached to the other end thereof, said first and second flanges having opposing first and second faces in sliding engagement with said first and second opposite ends respectively for guiding said second housing during movement thereof between said closed position wherein said elongated member is received within said opening and urging each of said conductors of said flexible circuit within said opening against a respective one of said plurality of contacts and said open position wherein said flexible circuit is free to be inserted into or removed from said opening, and a pair of positive stops associated with diagonally opposite corners of said first and second housings holding said second housing captive to said first housing during said movement of said second housing.

8. An electrical connector for interconnecting conductors of a flexible circuit to conductive traces on a printed circuit board comprising:

(a) a first housing having first and second opposite ends and an opening for receiving an end of said flexible circuit;

(b) a plurality of contacts arranged in said first housing to contact said conductors of said flexible circuit, each contact having a tail for contact with a respective trace on said printed circuit board;

(c) a second housing associated with said first housing including an elongated member having a first flange attached to one end thereof and a second flange attached to the other end thereof, said first and second flanges having opposing first and second faces in sliding engagement with said first and second opposite ends respectively for guiding said second housing during movement thereof between a closed position wherein said elongated member is received within said opening and urging each of said conductors of said flexible circuit within said opening against a respective one of said plurality of contacts and an open position wherein said flexible circuit is free to be inserted into or removed from said opening, a first projection extending outwardly from said first face, and two spaced indentations in said first opposite end arranged so that when said second housing is in said first position said first projection is in one of said indentations, and when said second housing is in said second position said first projection is in the other of said indentations, wherein said first projection is arranged to cam out of said one indentation when said second housing is moved from said open position to said closed position and to cam out of said other indentation when said cond housing is moved from said closed position to said open position.

9. The connector according to claim 8 including a second projection extending outwardly from said second face and two spaced indentations in said second opposite end arranged so that when said second housing is in said open position said second projection is in one of said indentations and when in said closed position said second projection is in the other of said indentations, wherein said second projection is diagonally opposite said first projection.

10. The connector according to claim 9 wherein said second projection includes a camming surface that is arranged to cam out of said one indentation, thereby resiliently deflecting said second flange away from said second opposite end, when said second housing is moved between said open and closed positions.

11. The connector according to claim 10 including means for holding said second housing captive to said first housing comprising a positive stop associated with corresponding adjacent diagonally opposite corners of said first and second housings.

12. The connector according to claim 11 wherein said diagonally opposite corners associated with said positive stop are spaced from said indentations in said first and second opposite ends.

* * * * *